US006467749B1

(12) United States Patent
van de Camp

(10) Patent No.: US 6,467,749 B1
(45) Date of Patent: Oct. 22, 2002

(54) CONCRETE COLUMN FORMING TUBE HAVING A TEAR STRIP THEREIN

(75) Inventor: Wim van de Camp, Meerssen (NL)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/651,868

(22) Filed: Aug. 31, 2000

(30) Foreign Application Priority Data

Dec. 15, 1999 (EP) ..... 99/125030

(51) Int. Cl.[7] ..... F04G 13/02

(52) U.S. Cl. ..... 249/48; 249/51; 249/112; 249/115; 249/188; 229/4.5; 229/93; 264/32; 264/310; 264/317; 264/338; 52/721.4; 52/742.14; 52/745.18

(58) Field of Search ..... 249/48, 51, 114.1, 249/115, 134, 49, 50, 61, 112, 188, DIG. 2; 264/311, 317, 333, 338, 32, 35, 310, 135, 228, 229; 138/128, 129, 137, 154, 145, 156, 150, 151; 229/4.5, 67, 93; 52/721.4, 745.17, 745.18, 742.14

(56) References Cited

U.S. PATENT DOCUMENTS

| | | | | |
|---|---|---|---|---|
| 2,677,165 A | | 5/1954 | Copenhaver et al. | |
| 2,914,833 A | | 12/1959 | Hart, Jr. et al. | |
| 3,020,615 A | * | 2/1962 | Peters | |
| 3,644,611 A | * | 2/1972 | Wiles | |
| 4,595,168 A | | 6/1986 | Goodwin | |
| 4,767,095 A | * | 8/1988 | Fitzgerald et al. | 249/48 |
| 4,957,270 A | | 9/1990 | Rummage et al. | |
| 5,043,033 A | * | 8/1991 | Fyfe | 156/71 |
| 5,328,142 A | * | 7/1994 | Weekers | 249/48 |
| 5,874,016 A | | 2/1999 | Bacon, Jr. et al. | |
| 6,220,564 B1 | * | 4/2001 | Costello | 249/48 |
| 6,260,816 B1 | * | 7/2001 | Valero Salinas | 249/48 |

FOREIGN PATENT DOCUMENTS

| | | |
|---|---|---|
| DE | 295 18 077 U1 | 5/1996 |
| GB | 8905989 | 8/1989 |
| WO | WO 93/14287 A1 | 7/1993 |

* cited by examiner

*Primary Examiner*—Yvonne M. Horton
(74) *Attorney, Agent, or Firm*—Alston & Bird LLP

(57) ABSTRACT

A concrete column forming tube is provided for receiving poured concrete therein to produce a concrete column and which eliminates spiral seam lines and other undesirable characteristics on the outside surface of the formed concrete column and provides a construction which may be easily removed from the concrete column. The forming tube includes a spirally-wound cylindrical paper tube including multiple plies of paper adhered together, a centrifugally-cast plastic coating sprayed on an inside wall surface of the spirally-wound paper tube for producing an inside coated surface having a thickness and smoothness sufficient to eliminate spiral seam lines and other undesirable characteristics, and a tear strip positioned between the inside surface of the cylindrical paper tube and the plastic coating before centrifugal-casting and extending longitudinally of the forming tube over the entire length thereof and having a predetermined width and readily detachable from the plastic coating. In producing a concrete column, the forming tube may be removed from the produced concrete column by pulling the tear strip from one-end of the forming tube to the other to tear open and remove a section of the cylindrical paper tube and produce a longitudinally-extending gap of a width equal to the predetermined width of the tear strip to receive therein a device for cutting through the plastic coating.

13 Claims, 2 Drawing Sheets

CONCRETE COLUMN FORMING TUBE HAVING A TEAR STRIP THEREIN

FIELD OF THE INVENTION

This invention relates to a concrete column forming tube and method of forming a poured concrete column which is characterized by and incorporates an improved device for aiding in removing the forming tube from the concrete column produced therein.

BACKGROUND OF THE INVENTION

For many years, concrete column forming tubes have been utilized and have been constructed of spirally-wound plies of paper adhered together and defining an inside wall surface of predetermined diameter which is coated with plastic material for concrete release properties. This plastic coating was usually provided by coating one side of the paper plies prior to spiral winding of the tube. These forming tubes received poured concrete therein which dried and set-up to produce a concrete column. The forming tube was then striped away from the concrete column and this operation was aided by the release properties of the plastic coating on the inside of the tube to leave a finished concrete column. These types of prior art tubes are disclosed in U.S. Pat. Nos. 2,677,165 and 2,914,833, for example, which are assigned to the assignee of the present invention.

Due to the spirally-wound construction of these forming tubes, spiral seam lines and other undesirable surface characteristics were usually present on the inside wall surface of the forming tube which resulted in spiral seam lines and other irregularities being molded on the outside surface of the produced concrete column. From an aesthetic standpoint, these spiral seam lines and other irregularities were usually undesirable on the produced concrete column and sandblasting or other finishing techniques were necessary to produce a smooth outside surface on the concrete columns.

In an effort to overcome these problems, concrete column forming tubes with separately-formed flexible cylindrical liners have been proposed by U.S. Pat. No. 4,595,168 and Assignee's U.S. Pat. No. 4,957,270. These separate liners were inserted into the concrete column forming tube after manufacture of the tube and often at the concrete column forming site. While these separate liners improved the surface quality of the resulting concrete column, they did often produce one vertical seam line running the length of the formed column, were expensive to manufacture, difficult to maintain and install, and presented other problems in the manufacture and use thereof.

More recently, these problems have been overcome by a concrete column forming tube construction as set forth in Assignee's U.S. Pat. No. 5,874,016 wherein a centrifugally-cast epoxy resin coating is sprayed onto the inside wall surface of a spirally-wound paper tube while the tube is rotating. This coating has a sufficiently low viscosity to produce an inside coated surface on the forming tube which extends continuously across the spiral seam lines and has a thickness and smoothness sufficient to eliminate spiral seam lines and other undesirable characteristics on the inside surface of the tube and on an outside surface of the formed concrete column. While this concrete column forming tube construction overcame these problems of spiral seam lines and other irregularities on the produced concrete column, it has been determined that these concrete column forming tubes are difficult to remove from the formed concrete column.

The problem of removal of concrete column forming tubes from the formed concrete column has been considered in the above-mentioned, Assignee's U.S. Pat. No. 2,677,165 wherein two diametrically opposed cutting wires are arranged on the inside surface of the concrete column forming tube. These cutting wires extend over the entire length of the concrete column forming tube and are used to tear open the tubular mold and to divide it into sections when it is desired to remove the concrete column forming tube from the formed concrete column. However, these cutting wires form longitudinally extending lines on the outside surface of the poured or formed concrete column and, thus, produce disadvantages in addition to those discussed above with respect to the undesirable spiral seam lines and other irregularities.

This latter problem of removal of the concrete column forming tube from the formed concrete column has also been addressed in German Utility Model Patent G 89 05 989.1, published Aug. 17, 1989, wherein a thread like or band-shaped ripping element was provided along the inside wall of the concrete column forming tube for ripping open the concrete column forming tube after the concrete column has been poured or formed. In the concrete column forming tube of this German Utility Model Patent, spiral seam lines and an image of the ripping element will be produced on the outside surface of the finished concrete column.

OBJECT AND SUMMARY OF THE INVENTION

Accordingly, it is the object of this invention to provide a concrete column forming tube for receiving poured concrete therein to produce a concrete column and which overcomes all of the problems set forth above by eliminating spiral seam lines and other undesired characteristics on an outside surface of the formed concrete column and by providing a construction which may be more easily removed from the formed concrete column.

By this invention, it has been found that the above object may be accomplished by providing a concrete column forming tube which is constructed of spirally-wound plies of paper adhered together and defining an inside wall surface having spiral seam lines thereon, and a centrifugally-cast plastic coating sprayed on the inside surface of the spirally-wound paper tube while the tube is rotating for producing an inside coated surface on the forming tube which eliminates spiral seam lines and other undesirable characteristics. A tear strip is positioned between the inside surface of the cylindrical paper tube and the plastic coating (prior to centrifugal-casting thereof) so as not to interfere with the smoothness of the inside coated surface of the forming tube. The tear strip extends longitudinally of the column forming tube over the entire length of the column forming tube. The tear strip has a predetermined width and is readily detachable from the plastic coating. In a preferred embodiment, a dent is pressed into the inside surface of the spirally-wound paper tube for receipt of the tear strip, so that the thickness of the plastic coating needed to produce a smooth inside surface in the forming tube can be reduced.

When it is desired to remove the forming tube from the concrete column produced, the tear strip is pulled from one end of the forming tube to the other end to tear open and remove a section of the cylindrical paper tube to produce a longitudinally-extending gap therein of a width generally equal to the predetermined width of the tear strip to receive or accommodate therein a device for cutting through the remaining plastic coating. Preferably, the tear strip is rolled-up on a longitudinally-extending instrument along with the section of paper tube being removed during opening of the forming tube. This device for cutting through the plastic coating may comprise a heat-omitting device or the blunt edge of a cutting instrument, etc.

Preferably, the tear strip is a reinforced plastic material and, more preferably, a glass fiber reinforced plastic tape.

Preferably, the centrifugally-cast plastic coating on the inside surface of the spirally-wound paper tube is a thermoplastic material, and more preferably, a polyurethane. A continuous wire may be positioned in each longitudinal edge of the tear strip. The tear strip is preferably at least 10 mm in width and, more preferably, between 10 and 50 mm in width. The concrete column forming tube may include two tear strips positioned at 180° of each other to facilitate removal of the forming tube from the concrete column.

BRIEF DESCRIPTION OF THE DRAWINGS

While some of the objects and advantages of the present invention have been set forth above, other objects and advantages will become apparent from the description of preferred embodiment of this invention, when taken in conjunction with the accompanying drawings, in which.

DETAILED DESCRIPTION OF PREFERRED EMBODIMENT OF THE INVENTION

Figure 1:
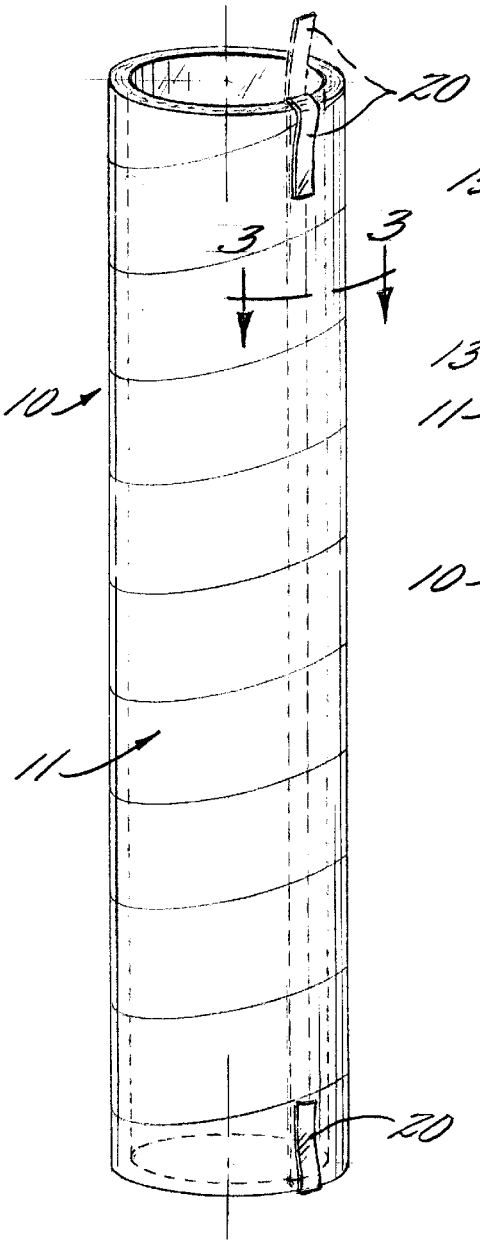
FIG. 1 is a perspective view of a concrete column forming tube constructed in accordance with the present invention.

Referring now to the drawings, there is illustrated therein a concrete column forming tube, generally indicated at 10, for receiving poured concrete therein to produce a concrete column C and which is constructed generally in accordance with the present invention.

This concrete column forming tube 10 comprises firstly an elongate rigid cylindrical tube 11 constructed from a plurality of spirally-wound plies 12 of paper adhered together and defining an inside wall surface 13 of predetermined diameter and having spiral seam lines thereon as a result of the spiral winding of the paper plies 12 into the tube 11. Spiral winding of the plurality of paper plies 12 to form a tube 11 is well understood by those of ordinary skill in the art.

The concrete column forming tube 10 further includes a centrifugally-cast plastic coating 15 deposited (preferably by spraying) on the inside wall surface 13 of the spirally-wound paper tube 11 while the tube is rotating to produce a smooth inside surface 16 in the forming tube 10. This centrifugally-cast plastic coating 15 is produced in a manner and by a method described in more detail in assignee's prior U.S. Pat. No. 5,874,016 (the disclosure of which is incorporated herein by reference) and this description may be consulted for a full understanding thereof. As explained in this '016 U.S. patent, the centrifugally-cast plastic coating has a thickness and smoothness sufficient to eliminate the spiral seam lines and other undesirable characteristics on the inside surface 13 of the spirally-wound paper tube 11 and thus eliminates these undesirable characteristics on the outside surface of the formed concrete column C.

In accordance with this invention, a tear strip 20 is positioned between the inside wall surface 13 of the spirally-wound cylindrical paper tube 11 and the plastic coating 15 on the inside wall surface 13 thereof. This tear strip 20 extends longitudinally of the column forming tube over the entire length of the column forming tube (as shown in FIG. 1) and preferably extends outwardly from at least one end and may extend outwardly from both ends of the concrete column forming tube 10 for grasping by a user. During shipping and handling these outwardly-extending ends of the tear strip 20 may be bent over and adhered to the forming tube 10 outside surface. This outside surface may be coated with polyethylene so that the tear strip 20 may be easily pulled off. The tear strip 20 has a predetermined width and is readily detachable from the plastic coating 15. The tear strip 20 is positioned on the inside wall surface 13 of the paper tube 11 before centrifugally-casting the plastic coating 15, so that the plastic coating 15 can be applied in a sufficient thickness to cover the tear strip 20 to produce a smooth inside surface 16 in the forming tube 10 (as shown in FIG. 3) to prevent an outline of the tear strip 20 being molded on the outside surface of the concrete column C.

Figure 3A:
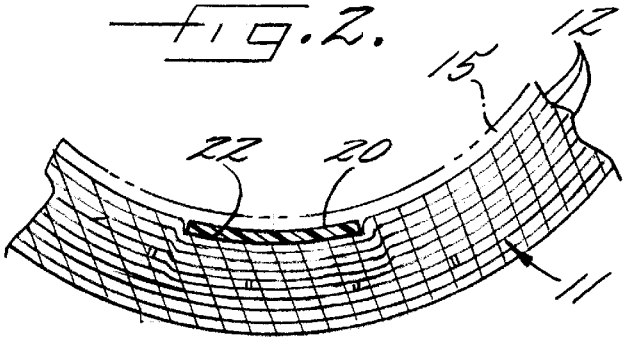
FIG. 3A is a view, like FIG. 3, of a modified embodiment of concrete column forming tube.
Figure 3:
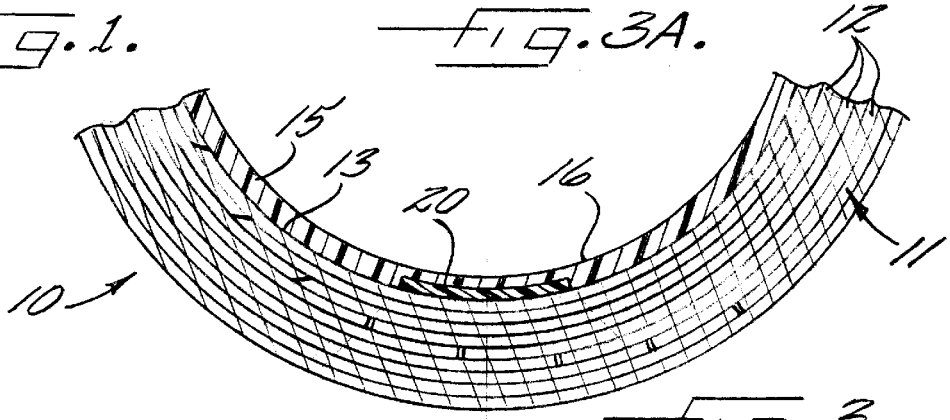
FIG. 3 is an enlarged partial cross-sectional view through the concrete column forming tube of FIG. 1 and taken generally along the line 3—3 of FIG. 1.

In a preferred embodiment of this invention (as shown in FIG. 3A) the paper tube 11 may preferably include a dent 22 pressed into the inside surface 13 and extending from one end of the paper tube 11 to the other end of the paper tube 11 and having a width sufficient to receive the tear strip 20 therein. With this construction, the thickness of the centrifugally-cast plastic coating 15 sufficient to produce a smooth inside surface 16 in the forming tube 10 may be reduced since the tear strip 20 does not stand up or extend outwardly from the inside wall 13 of the paper tube 11 to the extent it does in the embodiment illustrated in FIG. 3. The plastic coating 15 in FIG. 3A is shown in phantom lines so as to better illustrate the above-described construction.

When it is desired to remove the forming tube 10 from the concrete column C produced, the tear strip 20 may be pulled from one end of the forming tube 10 (see FIG. 2) to the other end to tear open and remove a section of the cylindrical paper tube 11 and to produce a longitudinally-extending gap G therein of a width generally equal to the predetermined width of the tear strip 20 and to provide a gap G of sufficient dimensions to receive a device therein (two of which are shown in phantom lines in FIG. 4) for cutting through the plastic coating 15 which still remains on and surrounds the produced concrete column C due to the position of the tear strip 20. Preferably, this is accomplished by rolling up the tear strip 20 and the section of the paper tube 11 being removed to produce the longitudinally-extending gap G onto a generally cylindrical instrument (such as the handle of a hammer or the like) so that the tear strip 20 will not deform in the direction of its width during the tearing open of the cylindrical paper tube 11 (as clearly shown in FIG. 2).

For constructing the elongate rigid cylindrical paper tube 11 which includes spirally-wound paper plies 12 and suitable paper materials for use therein, reference may be had to the detailed disclosure of the above referenced assignee's U.S. Pat. No. 5,874,016. Also, reference may be had to this same '016 U.S. patent for a detailed description of the materials and methods which may be used for centrifugally-casting a plastic coating 15 on the inside surface 13 of the paper tube 11. In addition to the disclosure set forth in this prior art patent, it has been determined by this invention that polyurethane is the preferred resin for the plastic coating 15. Once cured, polyurethane is neutral and can be treated as household waste. It is very important that the E-modulus of the resin be similar to the E-modulus of the paper tube. It is very likely that concrete column forming tubes are poorly handled during transportation and on the site for forming the concrete columns. If the difference between the E-modulus of the paper tube and the plastic coating is too large, there is a risk of delamination of the coating and the paper tube when a core is dropped. Polyurethane has an E-modulus of a level compatible with the E-modulus of materials used in a typically formed spirally-wound paper tube. Polyurethane is also a thermoplastic material and can be softened and removed with a heat-emitting device, as discussed more fully below.

Figure 6:
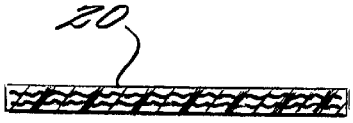
FIG. 6 is a cross-sectional view through a preferred construction of a tear strip in accordance with this invention.
Figure 7:
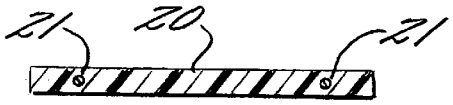
FIG. 7 is a cross-sectional view through another embodiment of a tear strip constructed in accordance with this invention.

The tear strip 20 to be used in accordance with this invention is constructed from a reinforced plastic material. The tear strip must have good tensile strength. It has been determined that a glass fiber reinforced plastic tape, which is available from the 3M Company under their trade name "Scotch 890" will meet the criteria and satisfactorily perform as the tear strip 20. Such glass fiber reinforced plastic tear strip 20 is illustrated in cross-section in FIG. 6. If desired, this tear strip 20 may include continuous wires 21 in the longitudinal edges thereof (as shown in FIG. 7) to aid the tear strip 20 in tearing open the paper tube 11 for removal of the forming tube 10 from the concrete column C.

Figure 8:
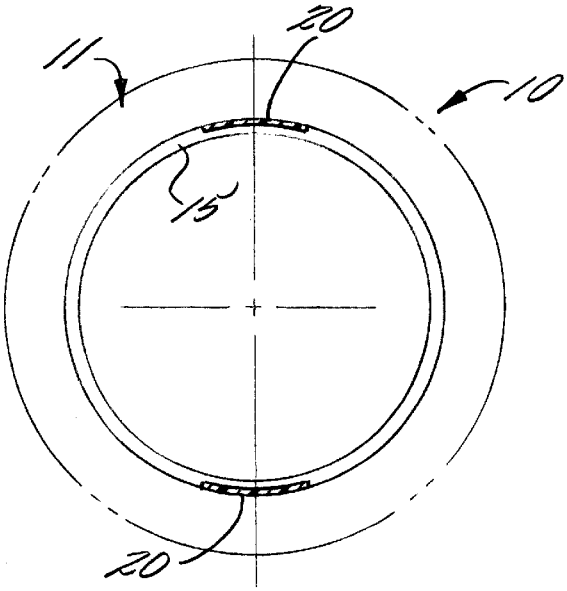
FIG. 8 is a sectional view through a concrete column forming tube constructed in accordance with this invention and having a pair of tear strips positioned at 180° with respect to each other.

Preferably, the tear strip 20 is at least 10 mm in width and, more preferably, between 10–50 mm in width. The desired width of the tear strip 20 depends upon the diameter of the concrete column forming tube 10. For example, it is preferred to use 12 mm wide tear strips 20 for standard 200 mm and 250 mm diameter forming tubes 10, 15 mm wide tear strips 20 for forming tube 10 diameters up to 400 mm, and 25 mm wide tear strips 20 for forming tube 10 diameters up to 700 mm. 800 mm diameter forming tube 10 would preferably utilize a 50 mm wide tear strip 20. In some cases, it may be desirable to utilize two tear strips 20 positioned at approximately 180° of each other between the inside surface 13 of the cylindrical paper tube 11 and the plastic coating 15 (as shown in FIG. 8). With the use of two tear strips 20, two halves of the forming tube 10 may be easily removed from the poured concrete column C.

Figure 2:
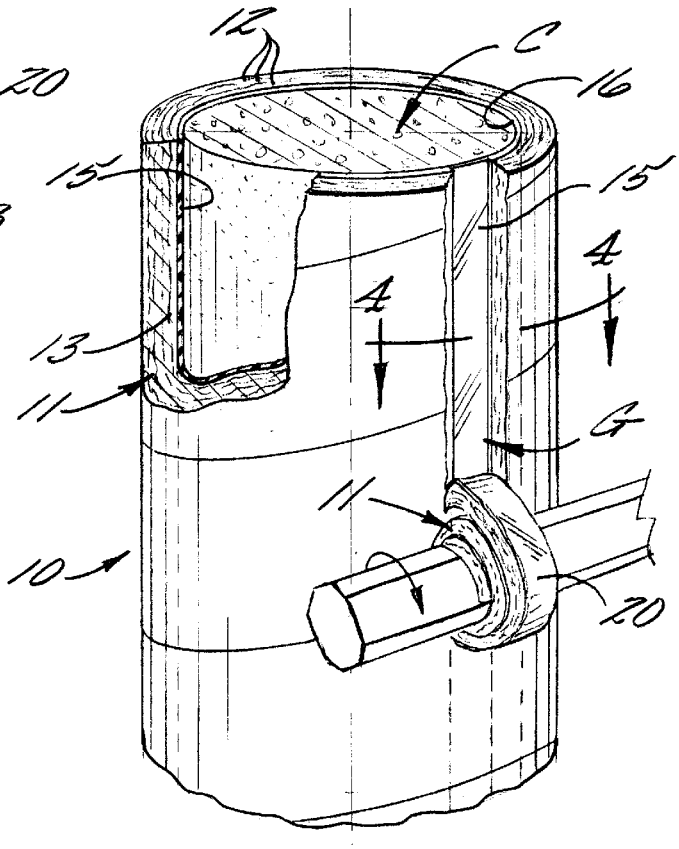
FIG. 2 is an enlarged partial perspective view of the upper end of the concrete forming tube of FIG. 1 after a concrete column has been formed therein and having a portion of the forming tube cut-away from the concrete column produced therein and illustrating the tear strip being pulled from one end of the forming tube.
Figure 4:
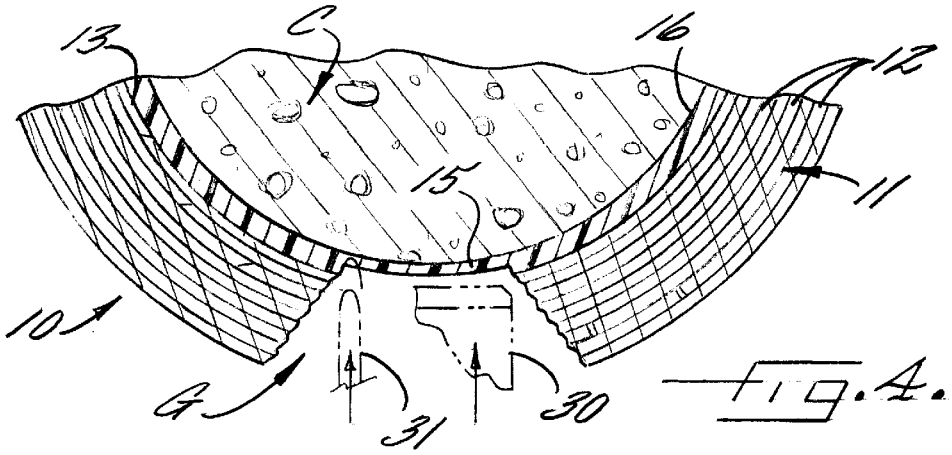
FIG. 4 is a view, like FIG. 3, and taken generally along the line 4—4 of FIG. 2 and showing a cross-section through the concrete column forming tube after the tear strip has been pulled to produce a gap of predetermined width therein.
Figure 5:
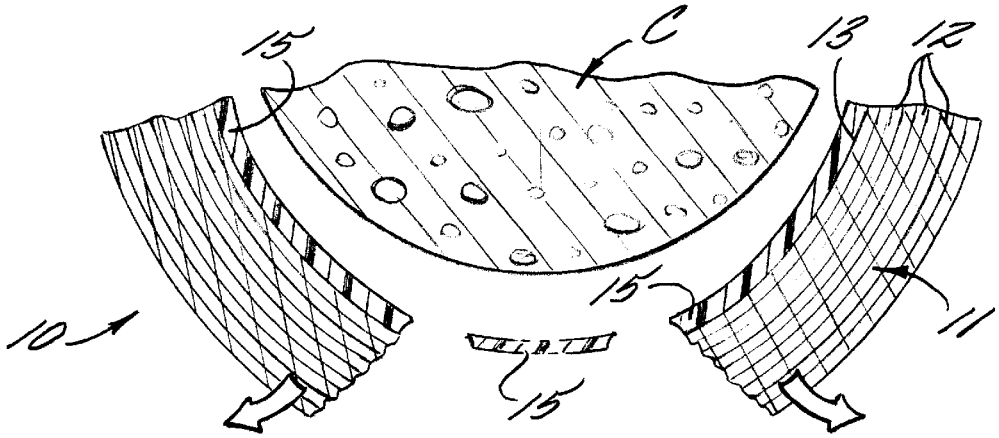
FIG. 5 is a view, like FIG. 4, after the plastic coating has been cut in the area of the gap and the forming tube is being pulled away from the concrete column produced.

As partially discussed above, the present invention has provided a method of forming a poured concrete column C which includes the steps of providing a concrete column forming tube 10 (constructed as discussed in detail above), pouring concrete into the forming tube 10 for producing a concrete column C having no seam lines or other undesirable characteristics on its outside surface, and removing the forming tube 10 from the concrete column C by pulling the tear strip(s) 20 from one-end of the forming tube 10 to the other end of the forming tube to tear open and remove a section of the cylindrical paper tube 11 (as shown in FIG. 2) and to produce a longitudinally-extending gap G therein (as shown in FIGS. 2, 4 and 5) of a predetermined width generally equal to the predetermined width of the tear strip 20. Preferably, this latter step includes rolling up of the tear strip 20 along with the section of paper tube 11 being removed to form the gap G onto a longitudinally-extending instrument (such as the handle of a hammer or the like).

In this manner, the tear strip 20 does not deform in the direction of its width and opens up a section of the paper tube 11 which generally corresponds to the width of the tear strip 20.

The plastic coating 15 from the inside of the concrete column forming tube 10 remains around the poured concrete column C after the tear strip 20 has been utilized to open up the gap G. This plastic coating 15 may be removed from the concrete column C by the step of cutting through the plastic coating 15 by the use of a suitable device (see FIG. 4) which can be positioned within the longitudinally-extending gap G formed by the tear strip 20. This device may comprise a heat emitting device (indicated at 30 in phantom lines in FIG. 4) which heats and melts the thermoplastic coating 15 for easy removal from the concrete column C. The device may also include the blunt side or edge of a cutting knife or blade (generally indicated at 31 in phantom lines in FIG. 4). This blunt edge of a cutting knife can easily cut through the plastic coating 15, while not scaring or otherwise damaging the surface of the concrete column C. The shape of the gap G which is formed by the tear strip 20 (as discussed above) has generally the same width as the tear strip 20 on the inside and the sides of this gap G have a generally 135° angle going out, so that the outside of the gap G is wider than the inside (as clearly shown in FIGS. 4 and 5).

As may be seen from the above, this invention has provided a concrete column forming tube 10 which utilizes a centrifugally-cast plastic coating 15 on the inside surface thereof to eliminate spiral seam lines and other undesirable characteristics on the outside surface of the poured concrete column C, while incorporating therein a tear strip 20 of a desired construction to aid in removing of the forming tube 10 from the produced concrete column C. This tear strip 20 advantageously does not adversely affect the outside surface of the produced concrete column C since the tear strip 20 is positioned between the centrifugally-cast plastic coating 15 and the inside surface 13 of the spirally wound paper tube 11 so as not to interfere with the smooth inside surface 16 of the forming tube 10. The tear strip 20 includes a construction which allows the tearing open of a gap G in the spirally-wound paper tube 11 which accommodates the reception of a device 30, 31 for cutting through the plastic coating 15 remaining on the produced column C after opening up of the gap G to remove the forming tube 10 from the concrete column produced.

In the drawings and specification there has been set forth a preferred embodiment of the concrete column forming tube 10 and method of forming a concrete column C in accordance with this invention, and although specific terms are employed, they are used in a generic and descriptive sense only and not for purposes of limitation, the scope of the invention is defined in the following claims.

What is claimed is:

1. In a concrete column forming tube for receiving poured concrete therein to produce a concrete column and in which said forming tube comprises an elongate rigid cylindrical paper tube capable of receiving concrete therein to form a column and including spirally-wound plies of paper adhered together and defining an inside wall surface having spiral seam lines thereon, and a centrifugally-cast plastic coating sprayed onto said inside wall surface of said spirally-wound paper tube while said tube is rotating for producing a smooth inside coated surface on said forming tube having a thickness and smoothness sufficient to eliminate spiral seam lines and other undesirable line characteristics on an outside surface of the formed concrete column; the combination therewith of:

a generally flat tear strip positioned between said inside surface of said cylindrical paper tube and said plastic coating prior to centrifugal-casting thereof so as not to interfere with said smooth inside coated surface of said forming tube, said tear strip extending longitudinally of said column forming tube over the entire length of said column forming tube, said tear strip having a predetermined width and being readily detachable from said plastic coating, so that, when it is desired to remove said forming tube from the concrete column produced, said tear strip is pulled from one end of said forming tube to the other end to tear open and remove a section of said cylindrical paper tube having a width generally equal to the predetermined width of said tear strip for producing a longitudinally-extending gap therein of a width generally equal to the predetermined width of said tear strip to receive therein a device for cutting through said plastic coating, and wherein said tear strip further includes a continuous wire in longitudinal edges thereof.

2. In a concrete column forming tube, as set forth in claim 1, in which said tear strip comprises reinforced plastic.

3. In a concrete column forming tube, as set forth in claim 1 or 2, in which said plastic coating on said inside surface of said spirally-wound paper tube comprises a thermoplastic material.

4. In a concrete column forming tube, as set forth in claim 3, in which said thermoplastic material comprises polyurethane.

5. In a concrete column forming tube, as set forth in claim 1, in which said tear strip comprises a glass fiber reinforced plastic tape, and in which said plastic coating on said inside surface of said spirally-wound paper tube comprises polyurethane.

6. In a concrete column forming tube, as set forth in claim 1, 2 or 5, in which said tear strip projects and extends outwardly from at least one end of said tube for grasping by a user when tearing open said tube.

7. In a concrete column forming tube, as set forth in claim 1, 2 or 5, in which said tear strip is at least 10 mm in width.

8. In a concrete column forming tube, as set forth in claim 1, 2 or 5, in which said tear strip is between 10–50 mm in width.

9. In a concrete column forming tube, as set forth in claim 1, 2 or 5, in which two of said tear strips are positioned at approximately 180° of each other between said inside surface of said cylindrical tube and said plastic coating.

10. In a concrete column forming tube for receiving poured concrete therein to produce a concrete column and in which said forming tube comprises an elongate rigid cylindrical paper tube capable of receiving concrete therein to form a column and including spirally-wound plies of paper adhered together and defining an inside wall surface having spiral seam lines thereon, and a centrifugally-cast plastic coating sprayed onto said inside wall surface of said spirally-wound paper tube while said tube is rotating for producing a smooth inside coated surface on said forming tube having a thickness and smoothness sufficient to eliminate spiral seam lines and other undesirable line characteristics on an outside surface of the formed concrete column; the combination therewith of:

a generally flat tear strip positioned between said inside surface of said cylindrical paper tube and said plastic coating prior to centrifugal-casting thereof so as not to interfere with said smooth inside coated surface of said forming tube, said tear strip extending longitudinally of said column forming tube over the entire length of said column forming tube, said tear strip having a predetermined width and being readily detachable from said plastic coating, so that, when it is desired to remove said forming tube from the concrete column produced, said tear strip is pulled from one end of said forming tube to the other end to tear open and remove a section of said cylindrical paper tube having a width generally equal to the predetermined width of said tear strip for producing a longitudinally-extending gap therein of a width generally equal to the predetermined width of said tear strip to receive therein a device for cutting through said plastic coating, and wherein said cylindrical paper tube includes a dent pressed into said inside wall surface and extending longitudinally of said paper tube over the length thereof and having a width to receive said tear strip therein to reduce the thickness of said plastic coating needed to produce said smooth inside coated surface on said forming tube.

11. A method of forming a concrete column comprising the steps of:

providing a concrete column forming tube including an elongate rigid cylindrical paper tube constructed of spirally-wound plies of paper adhered together and defining an inside surface having a spiral seam line thereon, a centrifugally-cast plastic coating sprayed onto the inside wall surface of the spirally-wound paper tube while the tube is rotating for producing an inside coated surface of sufficient thickness and smoothness to eliminate the spiral seam line and other undesirable characteristics on its inside surface, and a tear strip positioned between the inside surface of the cylindrical tube and the plastic coating prior to centrifugal-casting thereof and extending longitudinally of the column forming tube over the entire length of the column forming tube and having a predetermined width and being of a construction which is generally non-deformable in the direction of its width and readily detachable from the plastic coating;

pouring concrete into said forming tube for producing a concrete column having no seam lines on its outside surface; and removing said forming tube from the concrete column produced by pulling the tear strip from one end of the forming tube to the other end of the forming tube to tear open and remove a section of the cylindrical paper tube and to produce a longitudinally-extending gap therein of a predetermined width equal to the predetermined width of the tear strip, and cutting through the plastic coating on the inside of the column forming tube which remains around the poured concrete column by inserting a heat-emitting device into the gap formed by said tear strip and heating the plastic coating.

12. A method of forming a concrete column, as set forth in claim 11, in which said step of cutting through the plastic coating includes cutting of the plastic coating with a blunt edge cutting device.

13. A method of forming a concrete column, as set forth in claim 11 or 12, wherein said step of pulling the tear strip from one end of the forming tube to the other end of the forming tube comprises rolling-up the tear strip along with the section of the paper tube being removed onto a longitudinally-extending instrument.

* * * * *